US008045738B2

(12) United States Patent
Sira

(10) Patent No.: US 8,045,738 B2
(45) Date of Patent: Oct. 25, 2011

(54) SYSTEM FOR MANAGING FEEDBACK

(75) Inventor: Sandeep Prasad Sira, Gilbert, AZ (US)

(73) Assignee: Zounds Hearing, Inc., Phoenix, AZ (US)

( * ) Notice: Subject to any disclaimer, the term of this patent is extended or adjusted under 35 U.S.C. 154(b) by 589 days.

(21) Appl. No.: 12/290,503

(22) Filed: Oct. 31, 2008

(65) Prior Publication Data

US 2010/0111339 A1 May 6, 2010

(51) Int. Cl.
*H04R 25/00* (2006.01)

(52) U.S. Cl. ..... 381/318; 381/93

(58) Field of Classification Search ..... 381/318, 381/93

See application file for complete search history.

(56) References Cited

U.S. PATENT DOCUMENTS 7,995,780 B2 * 8/2011 Pedersen et al. ..... 381/318

OTHER PUBLICATIONS http://www.cs.princeton.edu/sound/research/controllers/etabla/hillClimbing.m.

* cited by examiner

*Primary Examiner* — Tu-Tu Ho
(74) *Attorney, Agent, or Firm* — Paul F. Wille

(57) ABSTRACT

Feedback detection, adaptive notch filtering, and gain adjustment are combined for managing feedback. Feedback detection includes detection of short term and long term spectral peaks and assessing their magnitude, shape, rate of growth, and power concentration ratio. A plurality of notch filters are available and are allocated according to the spectral magnitude of the feedback detected. Wide band gain adjustment supplements the notch filters.

14 Claims, 3 Drawing Sheets

SYSTEM FOR MANAGING FEEDBACK

BACKGROUND TO THE INVENTION

A "speaker" generates sound from an electrical signal. In the hearing aid art, one often encounters the term "receiver" for such a device, which reads strangely to the uninitiated. "Electroacoustic transducer" is clumsy and pedantic. Thus, "speaker" is the term used for describing this invention.

A human ear canal is a narrow, irregular, tubular structure, approximately 25 mm in length. Coupling amplified sound to the eardrum at the inner end of the canal is not as simple as it might seem. In a hearing aid, a microphone is connected to a speaker by a high gain (60-80 dB) amplifier and is relatively close to the speaker, 1-5 cm.

If an acoustic path exists between the speaker and the microphone, sound from the speaker feeds back to the microphone. Feedback typically occurs at high frequencies due to the higher gain at these frequencies, where most hearing loss occurs. Technically, when the output from the speaker is coupled in phase to a microphone and the loop gain exceeds unity, there is feedback. Feedback is a sharp tonal sound, often at the higher frequencies.

Feedback manifests itself as an unpleasant squeal that quickly grows in magnitude until maximum amplification is reached. The squeal can be audible even to those several feet from the hearing aid. Feedback can be eliminated by reducing the gain of the amplifier by way of a volume control on the hearing aid. Often the wearer is obliged to adjust the gain frequently as the loudness of background sounds and the loudness of sounds of interest change. Feedback in a hearing aid can interfere with hearing and may cause the wearer not to use the hearing aid. High level feedback in a hearing aid may even damage the already impaired hearing of the wearer.

In most modern hearing aids, an adaptive feedback canceller is used to cancel feedback. A digital filter continuously models the feedback path and generates an estimate of the feedback signal. This estimate is subtracted from the incoming signal to provide feedback cancellation. Constraints must be imposed to ensure that audio quality is not sacrificed when the hearing aid is presented with tones or narrow band sounds that cause the digital filter to converge to incorrect values. While adaptive feedback cancellation is effective to a degree, false positives are a constant problem. Eliminating a tone when a user is listening to music, for example, can cause great frustration.

Eliminating feedback involves reducing loop gain at a particular frequency using a notch filter or reducing loop gain in a narrow band of frequencies using less selective filters. Using notch filters to reduce gain often requires computational resources that are inherently limited by the size and power consumption of the semiconductor chip implementing the filters, which is limited by the size of the hearing aid.

Hearing aids can be divided into four groups: Behind-The-Ear (BTE), In-The-Ear (ITE), In-The-canal (ITC), and Completely-In-the-Canal (CIC). Some BTE hearing aids have an advantage over other types because the speaker is relatively far from any microphone in the body of the hearing aid. This invention is applicable to all types of hearing aids and to other applications where acoustic feedback is a problem.

As is well known to those of skill in the art, once an analog signal is converted to digital form, all subsequent operations can take place in one or more suitably programmed microprocessors. Special purpose circuits can be used instead of general purpose circuits for improved efficiency or reduced cost. Reference to "signal," for example, does not require nor exclude a particular implementation and can be analog or digital. Data in memory, even a single bit, can be a signal. In other words, a block diagram can be interpreted as hardware, software, e.g. a flow chart or an algorithm, or a mixture of hardware and software. Programming a microprocessor and other devices is well within the ability of those of ordinary skill in the art, either individually or in groups.

In view of the foregoing, it is therefore an object of the invention to provide a system for managing acoustic feedback.

Another object of the invention is to eliminate or minimize false positives in an adaptive feedback cancellation system.

A further object of the invention is to provide improved feedback detection.

Another object of the invention is to accurately minimize the gain of a feedback signal.

A further object of the invention is to cancel feedback that cannot be handled by an adaptive feedback canceller within its prescribed limits.

Another object of the invention is to provide effective and rapid cancellation of feedback at more than one frequency.

A further object of the invention is to prevent a loss of gain at frequencies where feedback is not occurring even while feedback is being cancelled at one or more other frequencies.

Another object of the invention is to cause negligible degradation of audio quality while reducing feedback.

A further object of the invention is to handle varying amounts of feedback including catastrophic situations.

Another object of the invention is to provide feedback management with maximum use of available resources such as adaptive filters.

SUMMARY OF THE INVENTION

The foregoing objects are achieved by this invention in which feedback detection, adaptive notch filtering, and gain adjustment are combined for managing feedback. Feedback detection includes detection of short term and long term spectral peaks and assessing their magnitude, shape, rate of growth, and power concentration ratio. A plurality of notch filters are available and are allocated according to the spectral magnitude of the feedback detected. Wide band gain adjustment supplements the notch filters.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
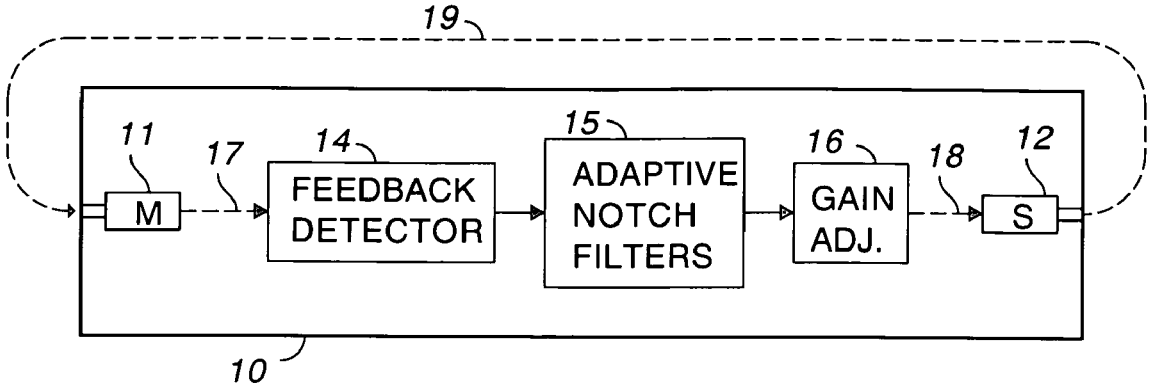
FIG. 1 is a block diagram of a hearing aid including feedback management in accordance with the invention.

In FIG. 1, hearing aid 10 includes microphone 11 for converting sounds to an electrical signal and speaker 12 for converting an electrical signal into sound. Within hearing aid 10 are feedback detector 14 having an output coupled to an input of adaptive notch filter 15, which, in turn, has an output coupled to an input of gain adjust 16. A variety of circuits, such as analog to digital converters, are coupled between microphone 11 and feedback detector 14, as indicated by dashed line 17, and between gain adjust 16 and speaker 12, as indicated by dashed line 18. Feedback from speaker 12 to microphone 11 is represented by dashed line 19.

As known in the art, an analog input signal is sampled in an analog to digital converter and a Fourier transform, computed via the Fast Fourier Transform (FFT) algorithm, is performed on the digital data to convert from time domain to frequency domain. Each transform operates on a frame of data samples to produce a plurality of frequency bins that contain data representing spectral magnitude.

Figure 2:
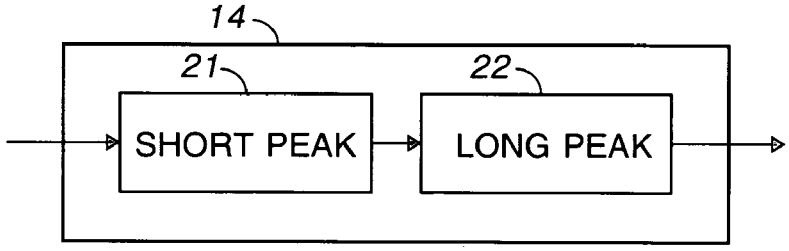
FIG. 2 is a block diagram of a feedback detector constructed in accordance with the invention.

In FIG. 2, feedback detector 14 includes short peak detector 21 and long peak detector 22. A "short peak" occurs in a single frame of data. A "long peak" is determined from a statistical evaluation of several frames. Unfortunately, "peak" generally refers to magnitude, not shape. In accordance with one aspect of the invention, the shape of a peak is evaluated to determine more accurately whether or not feedback is occurring. Height above neighboring valleys is also evaluated. As used herein, "peak detector" refers to a circuit that evaluates magnitude, shape, and relative height for detecting a peak.

Figure 3:
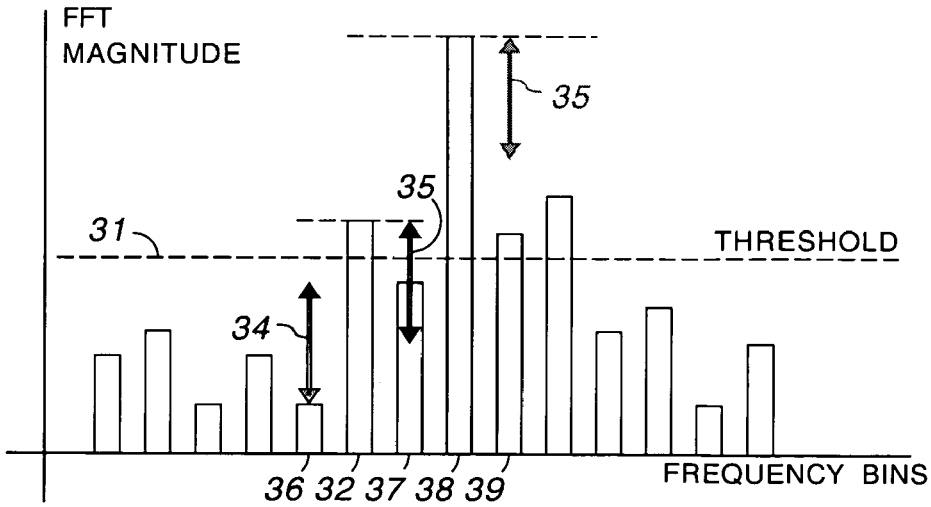
FIG. 3 is a chart illustrating the operation of the short peak detector in FIG. 2.

FIG. 3 illustrates a preferred implementation of the "hill climbing" algorithm for finding peaks. In FIG. 3, the hill climbing algorithm first checks to see whether the spectral magnitude at a frequency bin exceeds threshold 31. Bin 32 exceeds the threshold. Next, the algorithm determines whether or not the magnitude of bin 32 exceeds the magnitudes of adjacent bins, herein referred to as "valleys," by preset amounts, represented in FIG. 3 by arrows 34 and 35.

Bin 32 is larger than bin 36 by amount 34 but is not larger than bin 37 by amount 35. Thus, bin 32 does not qualify as a short peak.

Bin 38 is the next bin to exceed threshold 31. Note that in moving to bin 38, the valley is not updated. The comparison remains with bin 36. This ensures that local variations in FFT magnitude around a main peak do not affect the valley and thus prevent the main peak from being recognized. Bin 38 exceeds bin 39 by threshold 35 and is classified as a short peak. Once a short peak has been found, the valley is updated.

Although the thresholds are set as fixed values, they are preferably relative. Rising threshold (amount 34) and falling threshold (amount 35) are set as a fraction of the difference between the maximum and the minimum spectral magnitudes in is the frame. For convenience, the two thresholds are set to the same value. They need not have the same value.

A long peak is determined from short peak data, taking into account three factors: the peak duration (PD) of the short peak, the power concentration ratio (PCR) at the peak frequency, and the rate of change of magnitude (δ) of the peak. Of these factors, only (δ) truly characterizes feedback. The duration test helps to ensure that very short term spectral peaks do not get classified as feedback. (PCR) is high for pure tones but not for harmonic content, and has been used, by itself, as an indicator of feedback.

The rate of change of spectral magnitude from frame to frame is computed as $$\delta(m,k)=\alpha*\delta(m-1,k)+(1-\alpha)*(|X(m,k)|-|X(m-1,k)|)$$

where X(m,k) is the spectral component at frequency index k at frame index m. Thus, the rate of change of magnitude is smoothed over time. When the growth rate exceeds a predetermined threshold, the indicator function is set as $I_D(m,k)=1$. The threshold is determined empirically. A threshold of 0.117 has been found to be suitable.

The power concentration ratio at frequency bin k in frame m is computed as $$PCR(m,k)=\frac{\sum_{i=K-1}^{k+1}|X(m,k)|}{\sum_{i=0}^{N-1}|X(m,k)|}$$

and represents the fraction of total power concentrated in the neighborhood of a frequency bin. When PCR exceeds a predetermined threshold, the indicator function is set as $I_{PCR}(m,k)=1$. This threshold is also determined empirically and a value of 0.25 has been found to be suitable.

In order to facilitate feedback detection, a mechanism is necessary to fuse the attributes of peak duration (PD), power concentration ratio (PCR) and rate of magnitude change (δ). This is provided by the test statistic $$\lambda(m,k)=\alpha\lambda(m-1,k)+I_{PD}(m,k)(\beta_{PD}+I_{PCR}(m,k)\beta_{PCR}+I_{\delta}(m,k)\beta_{\delta}),$$

where, $\beta_{PD}$, $\beta_{PCR}$, and $\beta_{\delta}$, represent additive factors corresponding to duration PD, PCR, and δ. The indicator function $I_X(m,k)$ is one (1) if the threshold for the condition λ is met and is zero (0) otherwise. Thus, short peak detect, $I_{PD}(m,k)=1$, must occur before the $\beta_{PCR}$ and $\beta_{\delta}$ increments can be applied.

The assertion of feedback at frequency bin k is made if the smoothed test statistic exceeds a peak-set threshold.

$$\lambda(m,k)>\gamma_{set}.$$

Similarly, a previous feedback detect is de-asserted if the smoothed test statistic drops below a peak-drop threshold, i.e. if $\lambda(m,k)<\gamma_{drop}$. The thresholds are not equal, providing some hysteresis.

The process is fairly sensitive to the values of the constants $\beta_{PD}$, $\beta_{PCR}$, and $\beta_{\delta}$, because they determine the rate at which the test statistic grows. Assuming that $\lambda(i,k)>0$ at some time index i, and a continuous short peak detect, the test statistic at some time index i+n is bounded by $$\frac{\beta_{PD}}{1-\alpha}(1-\alpha^n)\le\lambda(i+n,k)\le\frac{\beta_{PD}+\beta_{PCR}+\beta_D}{1-\alpha}(1-\alpha^n).$$

Depending upon the values of α and n, the term $(1-\alpha^n)$ approaches unity and $$\frac{\beta_{PD}}{1-\alpha}\le\lambda(i+n,k)\le\frac{\beta_{PD}+\beta_{PCR}+\beta_D}{1-\alpha}.$$

Since spectral peak longevity is not a feature upon which feedback may be discriminated from narrow band inputs, it is useful to set $\beta_{PD}$ above such that it allows the test statistic to build relatively slowly. This allows the duration of feedback detection based only on spectral peaks to be longer than the duration typical of non-feedback, narrow band inputs, such as musical notes. If however, PCR or rapid growth rate is detected, the test statistic builds rapidly and feedback is detected much more rapidly. These relationships are shown in the following table.

| Parameter | Value |
|---|---|
| $\lambda_{set}$ | 0.5 |
| $\beta_{PD}/1-\alpha$ | 0.505 |
| $\beta_{CPR}/1-\alpha$ | 0.5 |
| $\beta_D/1-\alpha$ | 0.75 |

Figure 4:
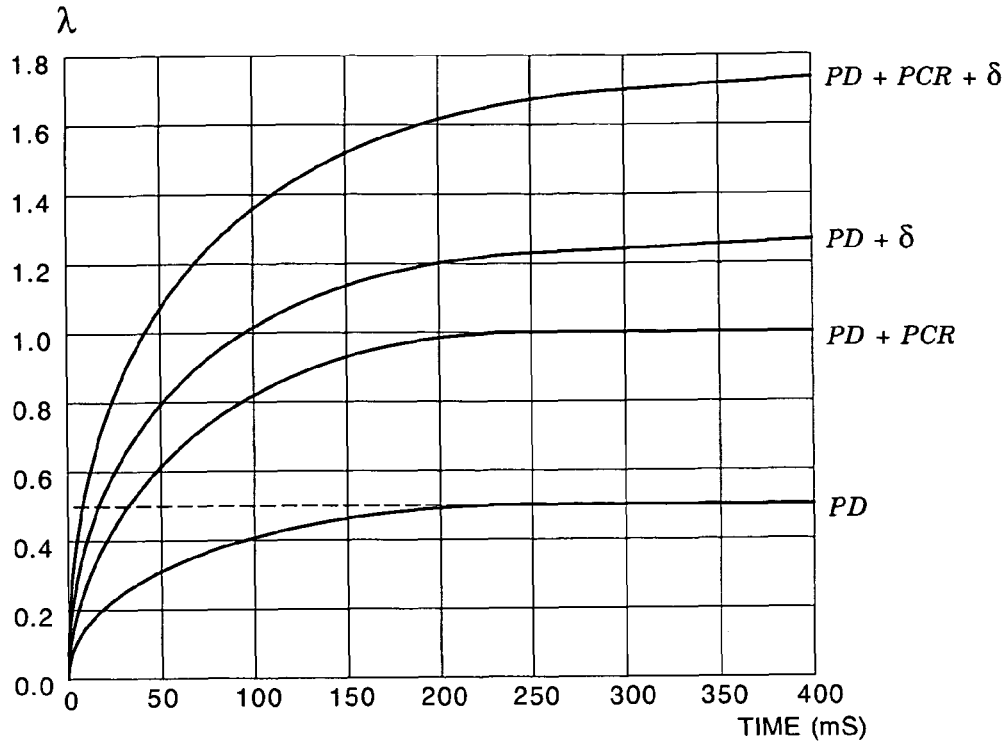
FIG. 4 is a chart illustrating the operation of the feedback detector illustrated in FIG. 2.

For $\alpha$=0.83, the values in the above table result in the rates of growth shown in FIG. 4. From FIG. 4, evaluating spectral shape (PD) takes a minimum of 200 ms. to detect feedback, whereas if PCR and magnitude growth ($\delta$) are detected, feedback detection occurs in less than 20 ms. The values given in the table and the value given for $\alpha$ are by way of example only. Suitable values are readily determined empirically for a given implementation.

Figure 5:
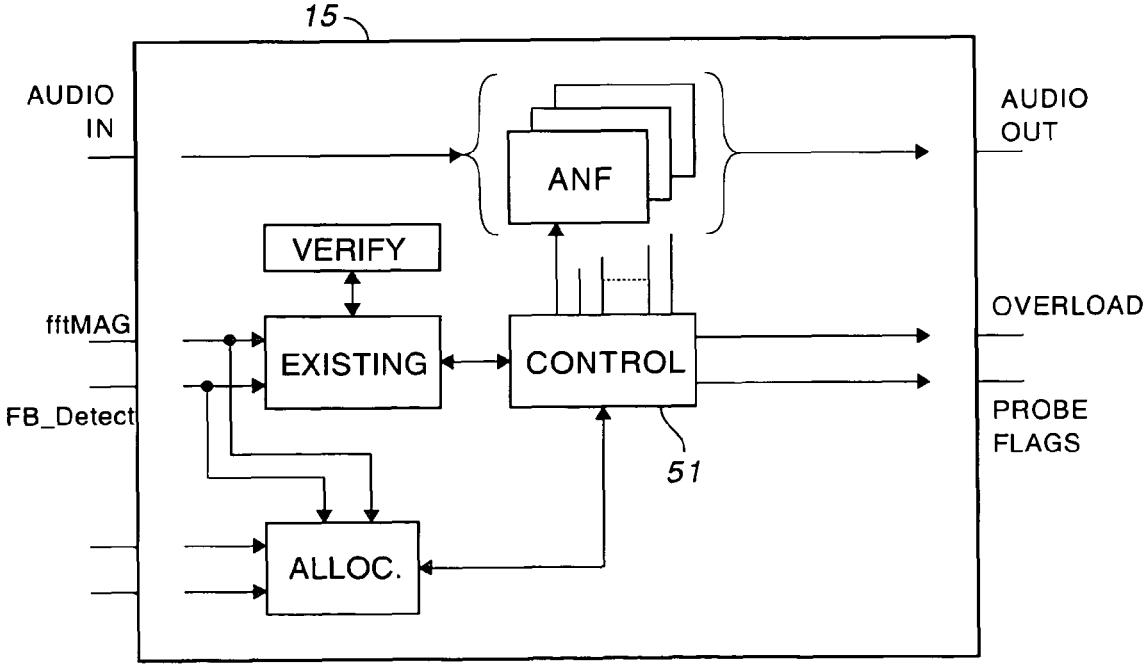
FIG. 5 is a block diagram of the adaptive notch filtering circuitry.

The feedback detector communicates with adaptive notch filter control logic 51 (FIG. 5). The frequencies at which feedback has been detected and their spectral magnitudes are sent to adaptive notch filter control logic 51, while probe flags are sent to the feedback detector circuit.

Experience suggests that feedback will not occur across the entire range of frequencies that a hearing aid processes. Thus, the feedback detector is currently restricted to locate feedback in the range 1250-7187.5 Hz.

The algorithm for adaptive notch filtering relies upon the feedback detector to provide an indication of the frequency bins at which feedback is occurring. However, despite all the checks in the feedback detector, it frequently mistakes highly tonal or narrow band inputs to be feedback. Accordingly, adaptive notch filter control 55 allocates notch filters based on spectral magnitude and monitors the effect of the introduction of the notch filter on the signal from the microphone. This is necessary to ascertain whether the reported feedback is genuinely feedback or is a narrow band input.

The adaptive notch filter communicates with the feedback detector by means of probe flags that, when asserted for frequencies at which feedback is expected, cause the feedback detector to lower its detection thresholds for those specified frequencies. This increases the sensitivity of the feedback detector selectively. The adaptive notch filter also provides an indication of overload (difference between the number of feedback bins and the number of notch filters in use) that can be used to cause further corrective action, such as gain reduction in the frequency band containing the concerned bin. This usually occurs in catastrophic situations where the feedback is too much to be controlled by selective gain reduction. In these scenarios a broadband gain reduction is necessary. Examples include hearing aid insertion or removal.

FIG. 5 illustrates the operation of the adaptive notch filters. The operation of the adaptive notch filters includes three steps, executed in the following order by control logic 51.

(1) Process existing notch filters. Each active notch filter operates in accordance with a set sequence that dynamically adjusts depth, width, and timings governed by a state machine associated with it.

(2) Assess new notch filter requests and allocate resources. There may not be enough notch filters to attack all the feedback peaks detected by the feedback detector. In addition, the feedback detector can produce false detects. In order to determine which frequencies are to be attacked, adaptive notch filter control logic 51 performs allocation of requests based primarily on spectral magnitudes.

(3) Calculate filter coefficients according to the frequency, width, and depth of a notch, as specified by the control logic.

During these steps, control signals, such as flags and overload information are generated. The algorithm writes the filter coefficients for each active notch filter to the appropriate filter coefficient memory registers.

The Notch Filters

Figure 6:
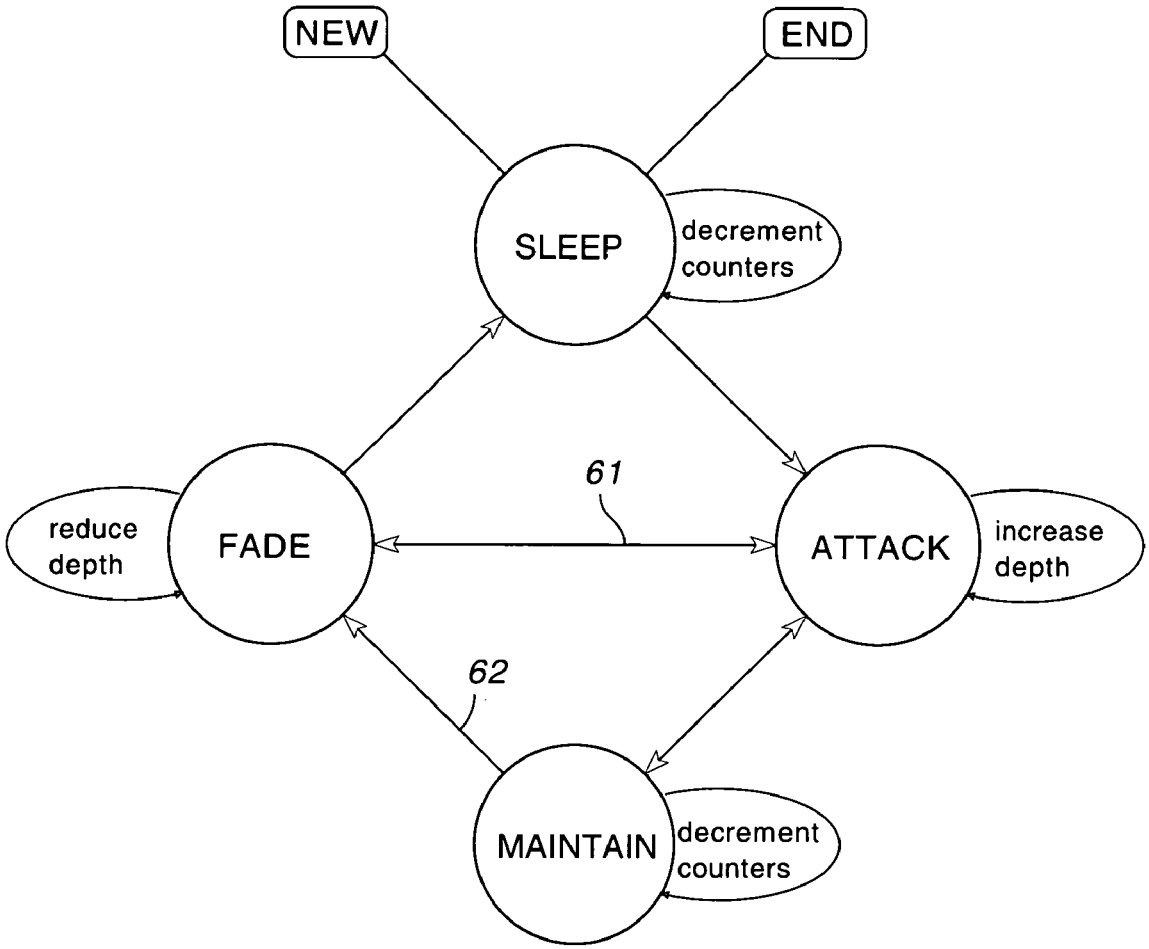
FIG. 6 is a state machine diagram for each notch filter.

A state machine, illustrated in FIG. 6, is associated with each notch filter. Four states are defined as ATTACK, MAINTAIN, FADE, and SLEEP (inactive). For feedback cancellation, a typical sequence is ATTACK→MAINTAIN→FADE→SLEEP. When a signal is determined to be a narrow band input rather than feedback, the sequence is ATTACK→FADE→SLEEP.

Existing Notch Filter Operations

Attack

When a notch filter is used to counter feedback, the initial notch depth is set to a minimum from a stored parameter. Adaptive notch filter control logic 51 then monitors the effect of the notch filter. If there is no effect, the signal was not generated by feedback in the hearing aid. Actual feedback will decrease in volume as soon as a notch filter is applied because the filter brings down the loop gain (that must exceed unity) of a real feedback signal. If, however, a signal is not feedback and is created by a valid stimulus, its input level will remain unaffected by the notch filter.

Due to system delays, a finite time must elapse before the effect of the notch filter is actually observed. Accordingly, a timer is set when the notch filter is activated. At each frame, the timer is decremented. When the timer counts down to zero, the depth of the notch is increased by 1 dB, subject to a maximum depth. In parallel with this process, the adaptive notch filter monitors the magnitude at the notch frequency (or bin). In each frame where the magnitude does not decrease, a counter is incremented. When this count exceeds a threshold, the feedback frequency is considered a narrow band input, an ignore flag is set for this frequency bin, and the notch filter then enters the FADE state.

During actual feedback, a notch filter will reduce spectral magnitude to the point where it causes the test statistic in the feedback detector to fall below a threshold and the feedback assertion is removed. In this case, the notch filter enters the MAINTAIN state.

In general, incremental changes are made in the ATTACK state and in the FADE state to avoid the perception of change. An exception is when feedback is so strong that the fixed-point spectral magnitude saturates; i.e. a bin remains at the maximum value that can be represented. When this happens, the assessment of whether or not the signal is a narrow band input is bypassed and the feedback is immediately attacked with the widest and deepest notch filter setting.

Maintain

Once a notch filter is used, feedback will subside. Although the feedback detector will not report feedback for this frequency bin, it is more than likely that the cause of the feedback still exists and removing the notch filter will cause the feedback to reappear. It is therefore necessary that the notch filter remains in place for some period. When a notch filter enters the MAINTAIN state, the notch depth is increased by a safety margin of 2 dB, a counter is preset to a value and then decremented with each frame. When the count reaches zero, the notch filter enters the fade state. The number of frames, i.e. the period, is not critical but must cover at least several seconds.

When a notch filter is in the MAINTAIN state, it is possible that a strong signal will occur at the notch frequency. If this is detected by the feedback detector, the notch depth is inadequate and the notch filter reverts to the ATTACK state. In this case, the starting notch depth is the current notch depth rather than the minimum notch depth described above.

Fade

A notch filter enters the FADE state from either the ATTACK state, path 61, or the MAINTAIN state, path 62. When the ATTACK state has determined that a signal is not feedback, the notch filter enters the FADE state to remove the notch filter rapidly. When the counter in the MAINTAIN state decrements to zero, the notch filter enters the FADE state. Either way, the depth of the notch filter is gradually reduced while decrementing a counter once each frame. When the count reaches zero, the notch filter is removed from the circuit and the state of that notch filter is set to SLEEP.

The difference between paths 61 and 62 is that path 61 includes an indication to the feedback detector that it should reduce its thresholds for classifying a spectral peak at the notch frequency as feedback. This is useful because feedback is likely to reappear at a frequency where it was successfully attacked if the environment that caused the feedback has not changed. The reduction of the thresholds increases detection sensitivity and will slow down or even prevent the removal of a notch, preventing audible appearances of short bursts of feedback. The indication is achieved by setting a flag that causes the feedback detector to decrease thresholds and smoothing constants. The flag is not set when the FADE state is on a frequency that has been classified as narrow band.

Sleep

When a notch filter is in SLEEP state, no processing is directly associated with it. However, two actions are necessary for frequencies that were either attacked as feedback or classified as narrow band. When a frequency was successfully attacked, the flag that was set during the FADE state is maintained for a preset number of frames. This allows quick determination of reappearing feedback. If however, the frequency was classified as narrow band, any reported feedback on this frequency is ignored for the same period because it is likely that any peak at this frequency is the result of a narrow band input. Accordingly these counters are decremented each frame. When the count is zero, for a flagged frequency, the flag is removed. For an ignored frequency, if a peak is still being reported by the feedback detector, a new notch filter is necessary and is processed accordingly.

New Notch Filter Operations

New requests for application of notch filters are processed by creating a list of notch filter frequencies; i.e. a list of certain frequencies at which the feedback detector has detected feedback. The frequencies are those that have not already been attacked with a notch filter and are not presently classified as an ignore frequency.

It is often likely that the number of potential feedback frequencies on the list exceeds the number of notch filters available. In this case, a selection has to be made for the allocation of resources. This is done by ordering the list in order of decreasing spectral magnitude. Any previously ignored frequencies on the list are left to the next frame for re-assessment.

Notch filters are allocated according to the ranked list. If notch filters are to be deployed at two neighboring frequencies, a single notch filter is used by increasing the notch bandwidth and centering it at the frequency bin that has the greater current spectral magnitude. In addition, the new notch filter state machine is set to ATTACK with the current notch depth. If a maximum bandwidth has already been reached, a second notch filter is allocated, if available.

Gain Adjustment

When the number of feedback frequencies detected by the feedback detector exceeds the number of available notch filters, it is likely that the hearing aid has become unusable. In such cases, the precise reduction of loop gain at specific frequencies, as with the notch filter approach, is no longer adequate and gains must be reduced across a wider band of frequencies. This is achieved by the gain adjust 16 in FIG. 1.

To achieve the gain adjustment, a count is maintained in each of several frequency bands of the number of feedback peaks that were not addressed by the adaptive notch filter logic. When the count in any frequency band exceeds zero, the gain in that band is decreased by a pre-determined amount, for a pre-determined period of time. For example, the gain may be reduced by 2 dB for 2 seconds. As long as the count in the band exceeds zero, the gain is continually reduced until a preset maximum adjustment level is reached.

The adjusted gain is held at the new level until such time the feedback count drops back to zero, i.e. the feedback has been controlled, and a preset time has elapsed. The time interval is necessary to prevent the gains from fluctuating too rapidly, which leads to audible artifacts.

The invention thus provides a system for managing acoustic feedback using a feedback detector, notch filters, and gain adjustment in a prescribed sequence. False positives are minimized or eliminated through improved feedback detection. The system is able to cancel feedback that cannot be handled by an adaptive feedback canceller within its prescribed limits. Feedback can be cancelled at more than one frequency without loss of gain at frequencies where feedback is not occurring. The system provides maximum use of available resources such as adaptive filters and can accommodate situations wherein the number of frequencies containing feedback is larger than the number of filters. ATTACK and FADE modes cause negligible degradation of audio quality while reducing feedback.

Having thus described the invention, it will be apparent to those of skill in the art that various modifications can be made within the scope of the invention. For example, the feedback detection algorithm can be modified, in its resolution, frequency range, or detection criteria, to suit the application. The number, depth, and bandwidth of the notch filters is determined by the hardware platform and can be changed as required. If a sufficient number of notch filters is available, the gain adjust mechanism can be removed.

What is claimed as the invention is:

1. A system for managing audio feedback, said system comprising:

a feedback detector, including a short peak detector and a long peak detector;

at least two adaptive notch filters coupled to said feedback detector; and a control circuit coupled to said feedback detector and to said at least two adaptive notch filters for setting the depth, width, and frequency of at least one of said adaptive notch filters in accordance with data from said feedback detector.

2. The system as set forth in claim 1 wherein said short peak detector evaluates magnitude and shape for detecting a spectral peak.

3. The system as set forth in claim 2 wherein said short peak detector evaluates relative height for detecting a peak.

4. The system as set forth in claim 1 wherein said short peak detector operates in frequency domain and sets a threshold as a fraction of the difference between the maximum spectral magnitude and the minimum spectral magnitude in a frame of data.

5. The system as set forth in claim 4 wherein said feedback detector operates on a plurality of frames of data and sets said threshold for each frame.

6. The system as set forth in claim 1 wherein said control circuit allocates adaptive notch filters in descending order of magnitude of peaks identified by said feedback detector.

7. The system as set forth in claim 1 wherein said control circuit reduces the threshold for feedback detection in said feedback detector after said feedback detector identifies a peak as feedback.

8. The system as set forth in claim 1 wherein said control circuit initially increases the depth of the notch of said at least one adaptive notch filter after allocating said at least one adaptive notch filter to reduce feedback.

9. The system as set forth in claim 8 wherein said control circuit gradually reduces the depth of the notch of said at least one adaptive notch filter after reducing feedback.

10. The system as set forth in claim 1 and further including a gain adjust circuit coupled to said notch filters.

11. The system as set forth in claim 10 wherein the gain adjust circuit gradually decreases system gain in a frequency band where feedback remains even after application of a notch filter.

12. In a hearing aid having a speaker and a microphone, the improvement comprising a system for managing feedback from said speaker to said microphone, wherein said system includes:

a feedback detector coupled to said microphone, said feedback detector including a short peak detector and a long peak detector;

at least two adaptive notch filters coupled to said feedback detector; and a control circuit coupled to said feedback detector and to said at least two adaptive notch filters for setting the depth, width, and frequency of at least one of said adaptive notch filters in accordance with data from said feedback detector.

13. The hearing aid as set forth in claim 12 wherein said system further includes a gain adjust circuit coupled between said notch filters and said speaker.

14. The hearing aid as set forth in claim 13 wherein the gain adjust circuit gradually decreases system gain in a frequency band where feedback remains even after application of a notch filter.

* * * * *